US011026531B2

(12) United States Patent
Campodonico

(10) Patent No.: US 11,026,531 B2
(45) Date of Patent: Jun. 8, 2021

(54) SECURE PACKAGE DELIVERY ASSEMBLY

(71) Applicant: Aldo Campodonico, Bridgewater, MA (US)

(72) Inventor: Aldo Campodonico, Bridgewater, MA (US)

( * ) Notice: Subject to any disclaimer, the term of this patent is extended or adjusted under 35 U.S.C. 154(b) by 169 days.

(21) Appl. No.: 16/288,221

(22) Filed: Feb. 28, 2019

(65) Prior Publication Data

US 2020/0275795 A1 Sep. 3, 2020

(51) Int. Cl.
*A47G 29/124* (2006.01)
*A47G 29/20* (2006.01)
*E06B 7/28* (2006.01)

(52) U.S. Cl.
CPC ..... *A47G 29/1248* (2017.08); *A47G 29/20* (2013.01); *A47G 2029/1257* (2017.08); *E06B 7/28* (2013.01)

(58) Field of Classification Search
CPC .... A47G 29/1248; A47G 29/20; A47G 29/22; A47G 29/141; A47G 29/14; A47G 29/16; A47G 2029/1257; A47G 2029/144; A47G 2029/148; A47G 29/12095; E06B 7/28
USPC ..... 232/17, 19, 22, 44, 45, 47, 54, 43.5
See application file for complete search history.

(56) References Cited

U.S. PATENT DOCUMENTS 378,955 A * 3/1888 Dubey ..... A47G 29/1207 232/30
403,790 A * 5/1889 Taylor ..... A47G 29/1201 232/24
4,703,850 A * 11/1987 Walker ..... A45C 3/12 206/288
4,909,052 A 3/1990 Hutwohl
5,027,948 A 7/1991 Forbes
5,624,071 A 4/1997 Sosan
6,155,715 A 12/2000 Lake
6,375,070 B1 * 4/2002 Snoke ..... A47G 29/141 232/20
6,840,438 B2 * 1/2005 Hassan ..... A47G 29/1216 232/39
D644,814 S 9/2011 Clarke
9,211,025 B1 * 12/2015 Elhawwashy ..... A47G 29/20
9,364,112 B2 6/2016 Sundaresan
9,596,952 B2 * 3/2017 Mencel ..... A47G 29/141
9,873,549 B2 * 1/2018 Heinz ..... A47G 29/141
10,143,321 B2 * 12/2018 Hippert ..... A47G 29/20
10,321,780 B1 * 6/2019 James ..... A47G 29/141
10,383,471 B1 * 8/2019 Barnes ..... A47G 29/20
(Continued)

FOREIGN PATENT DOCUMENTS

WO WO2016013937 1/2016

*Primary Examiner* — William L Miller

(57) ABSTRACT

A secure package delivery assembly for preventing return or theft of a package includes a first bracket and a box. The first bracket is configured to couple to one of an upper end and a lower end of a door so that a first plate of the first bracket, to which the box is coupled, is positioned in substantial abutment to an exterior face of the door. An aperture that is positioned in a top of the box is configured to allow insertion of a package. A retention assembly that is coupled to and positioned in the box is configured to deter extraction of the package through the aperture. An opening is positioned in a horizontal face of the box to allow a user to retrieve the package. A panel that is hingedly coupled to the horizontal face is selectively couplable to the box to securely close the opening.

17 Claims, 6 Drawing Sheets

(56) References Cited

U.S. PATENT DOCUMENTS

| | | | | |
|---|---|---|---|---|
| 10,512,352 | B1 * | 12/2019 | Torres | A47G 29/22 |
| 10,537,197 | B2 * | 1/2020 | Hopp | A47G 29/20 |
| 10,583,853 | B2 * | 3/2020 | Brilhante | A47G 29/141 |
| 10,682,002 | B2 * | 6/2020 | Miller | A47G 29/20 |
| 10,743,694 | B2 * | 8/2020 | Raphael | A47G 29/141 |
| 10,786,103 | B2 * | 9/2020 | Teoh | A47G 29/20 |
| 2016/0051073 | A1 * | 2/2016 | Heinz | A47G 29/141 232/39 |
| 2016/0068306 | A1 * | 3/2016 | Heinz | B65D 81/02 220/560.01 |
| 2016/0309939 | A1 * | 10/2016 | Mencel | A47G 29/20 |
| 2017/0127868 | A1 * | 5/2017 | Adewuyi | A47G 29/141 |
| 2017/0188737 | A1 * | 7/2017 | Hippert | A47G 29/20 |
| 2018/0296016 | A1 * | 10/2018 | Teoh | A47G 29/20 |
| 2018/0319502 | A1 * | 11/2018 | Maclay | B64D 11/0015 |
| 2019/0246828 | A1 * | 8/2019 | Miller | A47G 29/20 |
| 2019/0320836 | A1 * | 10/2019 | Guanch | A47G 29/20 |
| 2019/0350398 | A1 * | 11/2019 | Raphael | A47G 29/141 |
| 2020/0093309 | A1 * | 3/2020 | Raphael | A47B 67/02 |
| 2020/0093310 | A1 * | 3/2020 | Hauck | A47G 29/26 |

* cited by examiner

SECURE PACKAGE DELIVERY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to delivery assemblies and more particularly pertains to a new delivery assembly for preventing return or theft of a package.

BRIEF SUMMARY OF THE INVENTION

An embodiment of the disclosure meets the needs presented above by generally comprising a first bracket and a box. The first bracket is configured to couple to one of an upper end and a lower end of a door so that a first plate of the first bracket, to which the box is coupled, is positioned in substantial abutment to an exterior face of the door. An aperture that is positioned in a top of the box is configured to allow insertion of a package. A retention assembly that is coupled to and positioned in the box is configured to deter extraction of the package through the aperture. An opening is positioned in a horizontal face of the box to allow a user to retrieve the package. A panel that is hingedly coupled to the horizontal face is selectively couplable to the box to securely close the opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
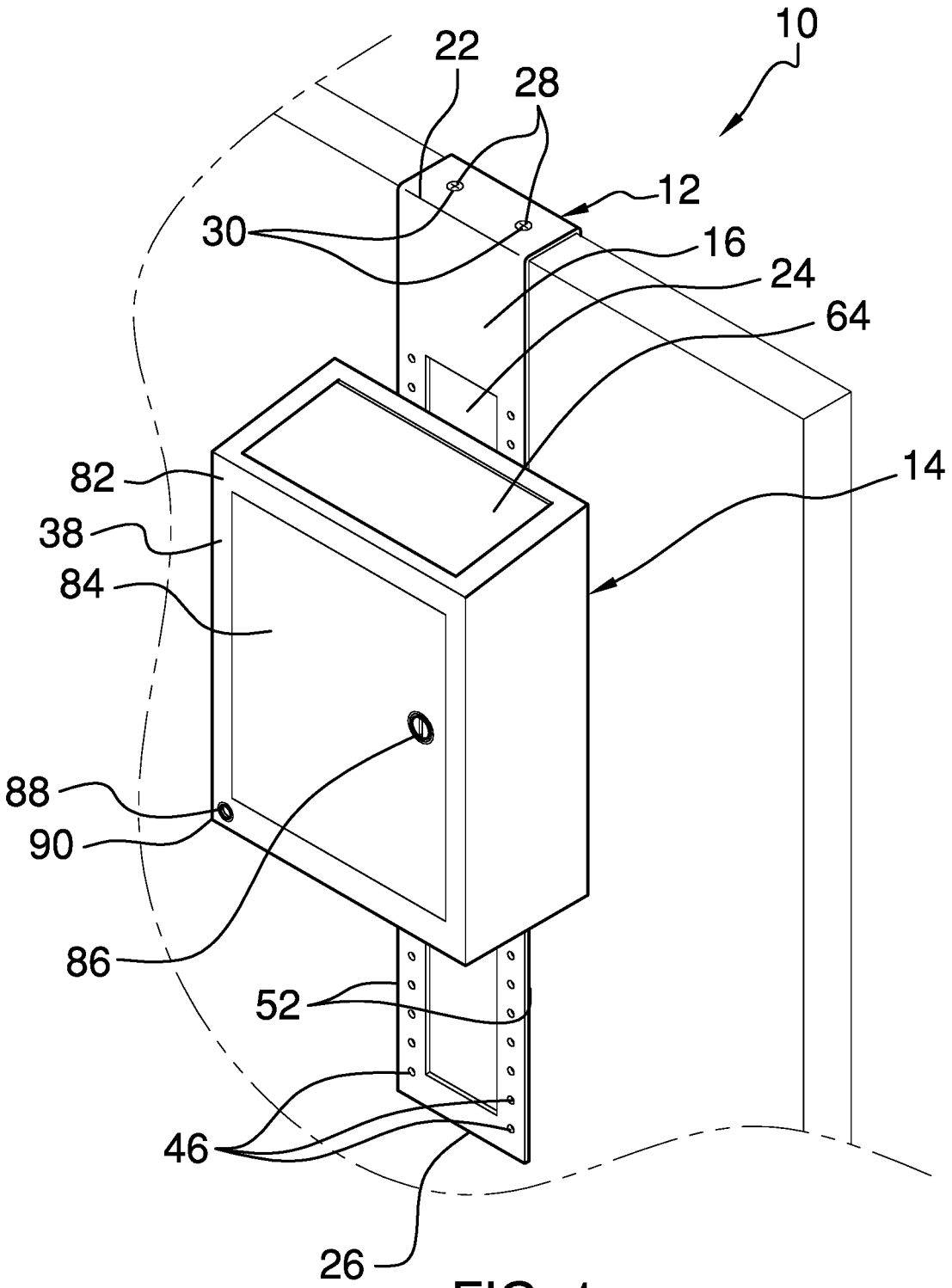
FIG. 1 is an isometric perspective view of a secure package delivery assembly according to an embodiment of the disclosure.

With reference now to the drawings, and in particular to FIGS. 1 through 6 thereof, a new delivery assembly embodying the principles and concepts of an embodiment of the disclosure and generally designated by the reference numeral 10 will be described.

As best illustrated in FIGS. 1 through 6, the secure package delivery assembly 10 generally comprises a first bracket 12 and a box 14. The first bracket 12 configured to selectively couple to one of an upper end and a lower end of an entry door of a structure so that a first plate 16 of the first bracket 12 is positioned in substantial abutment to an exterior face of the entry door.

The first bracket 12 also comprises a second plate 18 and a third plate 20. The second plate 18 is coupled to and extends perpendicularly from a first endpoint 22 of the first plate 16. The third plate 20 is coupled to and extends perpendicularly from the second plate 18 distal from the first plate 16 so that the first bracket 12 is C-channel type. The first bracket 12 is configured to selectively insert the one of the upper end and the lower end of the entry door, positioning the first plate 16, the second plate 18, and the third plate 20 in substantial abutment to the exterior face, the one of the upper end and the lower end, and an interior face of the entry door, respectively. Thus positioned, the first bracket 12 would be difficult or impossible to remove from the entry door when the entry door is closed and locked.

A cutout 24 is positioned in the first plate 16 to lower a mass of the first bracket 12. The cutout 24 extends from proximate to the first endpoint 22 to proximate to a second endpoint 26 of the first plate 16.

A pair of end plate holes 28 is positioned in the second plate 18 so that each end plate hole 28 is positioned to accept a plate screw 30 to selectively couple the second plate 18 to the one of the upper end and lower end of the exterior door to further secure the first bracket 12 to the entry door.

A pair of interior plate holes 32 is positioned in the third plate 20. The interior plate holes 32 are threaded so that each interior plate hole 32 is positioned to threadedly insert a plate bolt 34. The plate bolt 34 is configured to be tightened to removably clamp the first bracket 12 to the exterior door, allowing the first bracket 12 to be coupled to entry doors having a variety of thicknesses. The plate bolt 34 is clamping type so that a knob 36 of the plate bolt 34 is configured to be selectively rotated, by action of a hand of a user, to removably clamp the first bracket 12 to the exterior door.

The box 14 is coupled to the first plate 16 of the first bracket 12. The box 14 has a front 38 and a back 40, with the back 40 being dimensionally taller than the front 38 so that a top 42 of the box 14 tapers downwardly from the back 40 to the front 38. The box 14 thus is configured to allow runoff of water from the top 42.

A plurality of first couplers 44 is coupled to the back 40 of the box 14. A plurality of second couplers 46 is coupled to the first plate 16. The second couplers 46 are complementary to the first couplers 44 so that each second coupler 46 is positioned to selectively couple to a respective first coupler 44 to couple the box 14 to the first plate 16 at a selected position between the first endpoint 22 and the second endpoint 26 of the first plate 16.

The plurality first couplers 44 comprises a plurality of first holes 48. The plurality of second couplers 46 comprises a plurality of second holes 50. Each second hole 50 is positioned proximate to a respective opposing edge 52 of the first plate 16 so that the second hole 50 is selectively alignable with a respective first hole 48, positioning the second hole 50 and the respective first hole 48 for insertion a respective bolt 54 so that the respective bolt 54 is positioned to be coupled to a respective nut 56 to couple the box 14 to the first plate 16.

The plurality of first holes 48 comprises four first holes 48. The plurality of second holes 50 comprises two rows 58 of second holes 50 that are positioned singly proximate to each opposing edge 52 of the first plate 16. Each row 58 extends from proximate to the first endpoint 22 to proximate to the second endpoint 26 of the first plate 16.

Each of a plurality of washers 60 is selectively positionable over a respective bolt 54, between a respective nut 56 and the back 40 of the box 14, so that the washer is positioned to facilitate rotation of the respective nut 56 on the respective bolt 54.

An aperture 62 that is positioned in the top 42 of the box 14 is configured to allow insertion of a package into the box 14 by a delivery agent, as may be required when a recipient of the package is not available to accept delivery. The aperture 62 is rectangularly shaped so as to complement the shape of the majority of packages. A lid 64 is hingedly coupled to the top 42 of the box 14 so that the lid 64 is positioned to selectively close the aperture 62.

A retention assembly 66 is coupled to and is positioned in the box 14 proximate to the top 42. The retention assembly 66 is configured to deter extraction of the package through the aperture 62, thus deterring theft of the package.

The retention assembly 66 comprises a plurality of first tines 68 and a plurality of second tines 70. The first tines 68 and the second tines 70 are hingedly coupled to and extend substantially perpendicularly from the front 38 and the back 40 of the box 14, respectively, into the aperture 62 so that a terminus 72 of each first tine 68 and an end 74 of each second tine 70 are positioned substantially equally distant from the front 38 and the back 40. The first tines 68 and the second tines 70 are spring-loaded so that the first tines 68 and the second tines 70 are configured to pivot toward a bottom 76 of the box 14, to insert the package, and to rebound, to deter extraction of the package through the aperture 62.

The first tines 68 and the second tines 70 are arcuate so that the first tines 68 and the second tines 70 extend arcuately toward the bottom 76 of the box 14, thus facilitating insertion of the package into the box 14. The first tines 68 and the second tines 70 are alternately positioned relative to opposing sides 78 of the box 14. The plurality of first tines 68 comprises from three to seven first tines 68. The plurality of second tines 70 comprises from four to eight second tines 70. The plurality of first tines 68 may comprise five first tines 68 and the plurality of second tines 70 may comprise six second tines 70.

Figure 2:
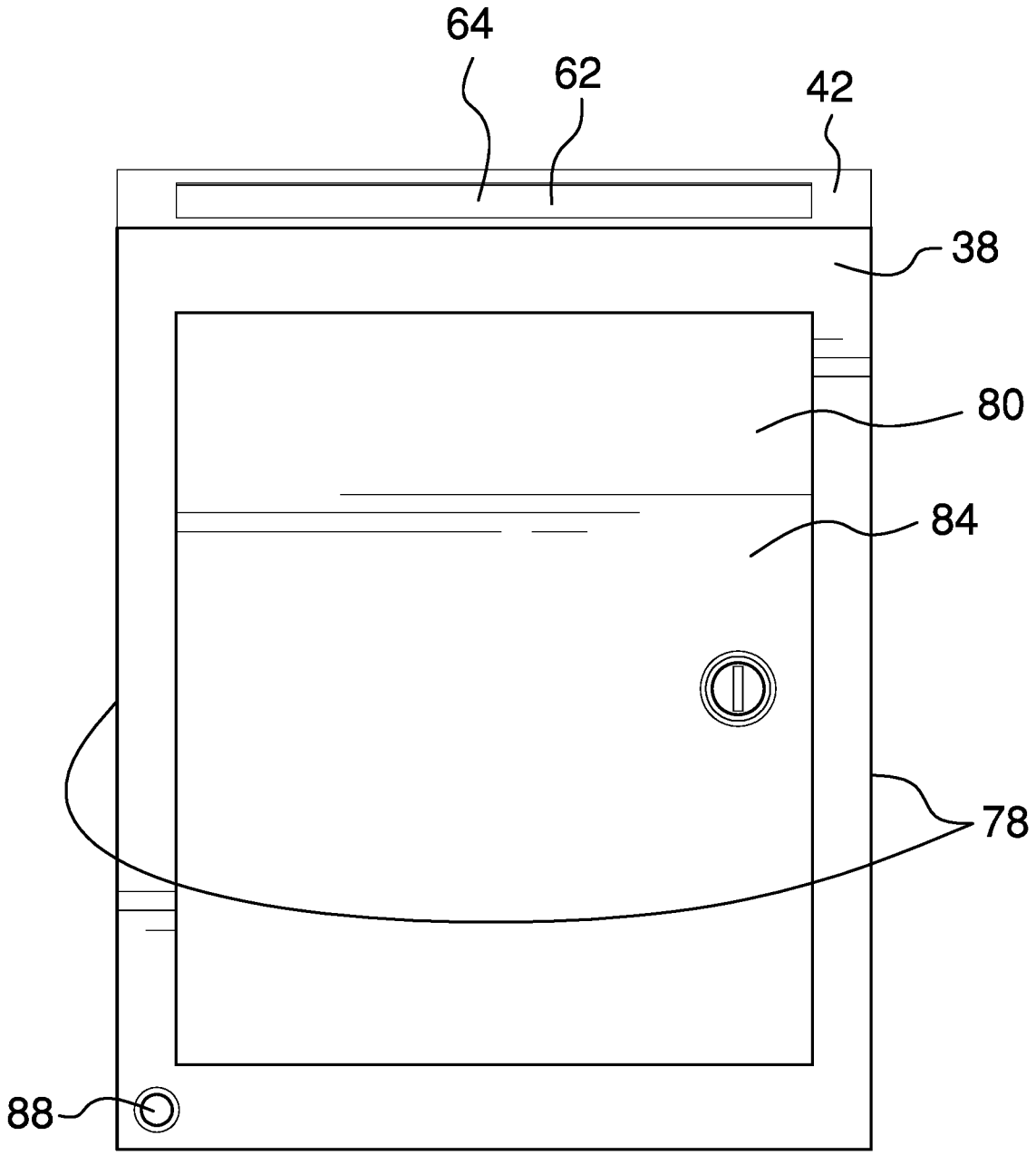
FIG. 2 is a front view of an embodiment of the disclosure.
Figure 3:
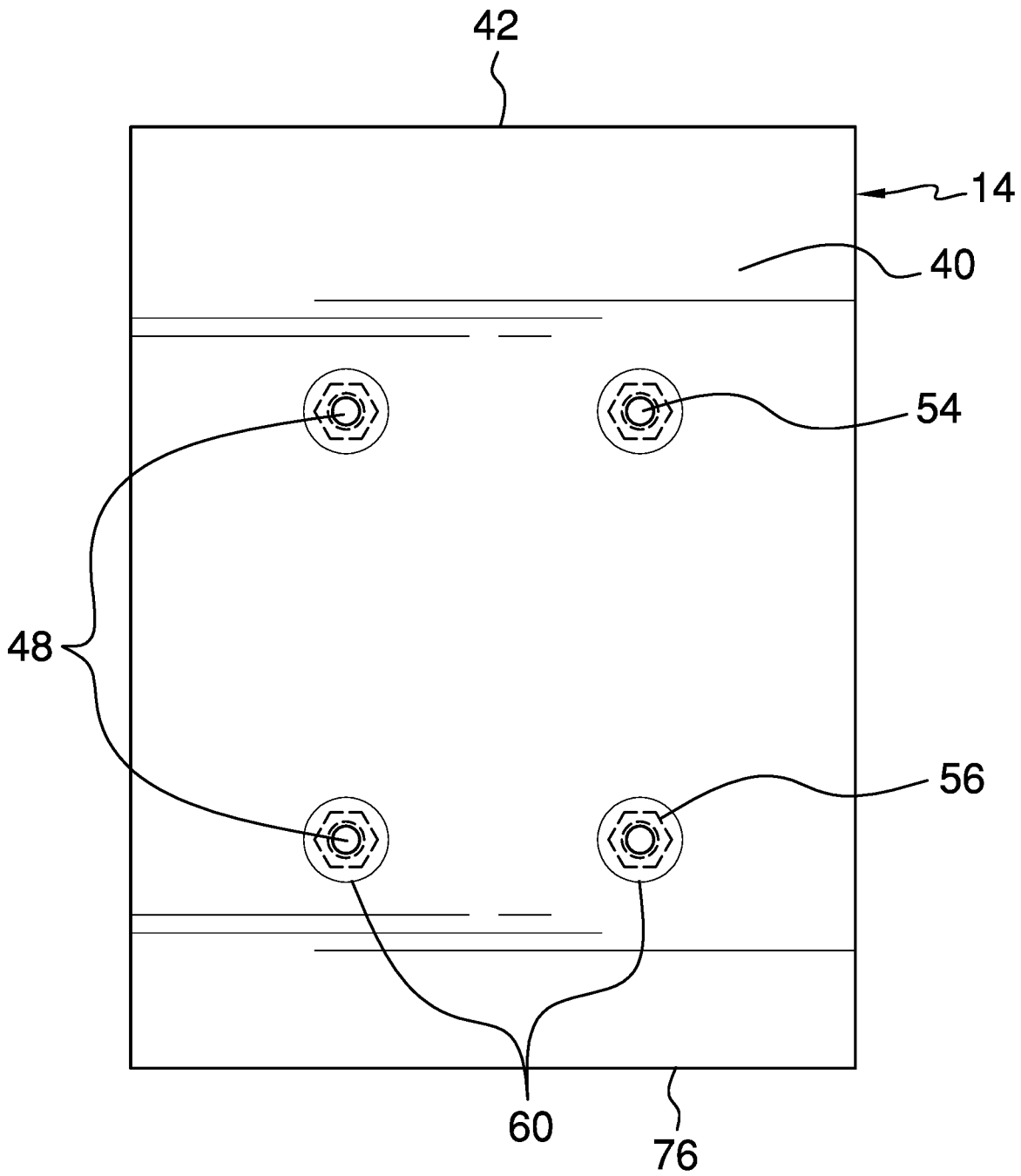
FIG. 3 is a back view of an embodiment of the disclosure.
Figure 5:
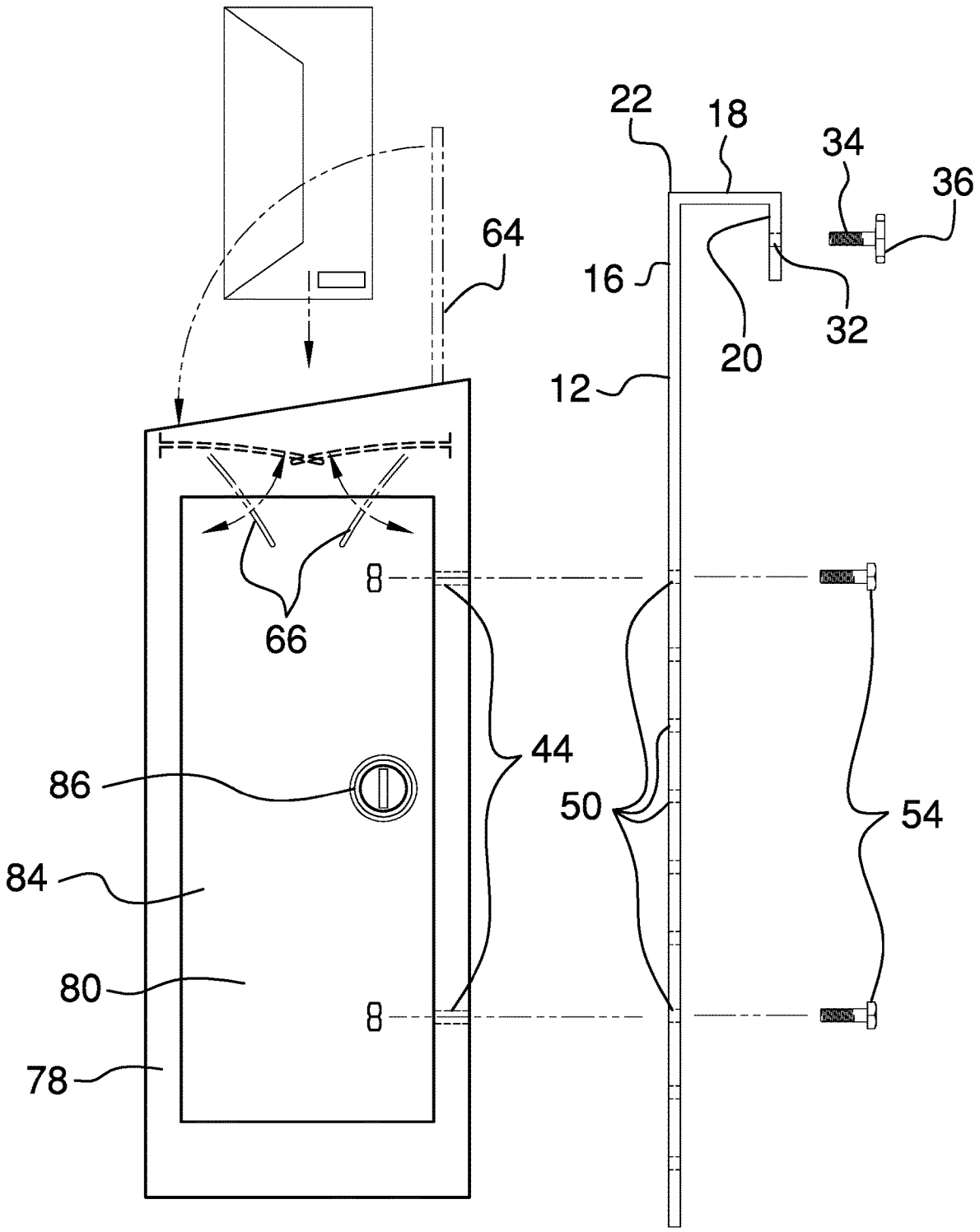
FIG. 5 is a side view of an embodiment of the disclosure.

An opening 80 is positioned in a horizontal face 82 of the box 14 so that the opening 80 is positioned to allow a user to retrieve the package from the box 14. The opening 80 is rectangularly shaped. The opening 80 may be positioned in a front 38 of the box 14, as shown in FIG. 2, or in a respective opposing side 78 of the box 14, as shown in FIG. 5.

A panel 84 is hingedly coupled to the horizontal face 82. The panel 84 is selectively couplable to the box 14 so that the panel 84 is positioned to selectively and securely close the opening 80. A lock 86 that is coupled to the panel 84 is selectively couplable to the box 14 so that the lock 86 is positioned to lock the panel 84 in a closed configuration, as shown in FIG. 2, to deter theft of the package in the box 14. The lock 86 is key operated.

Figure 4:
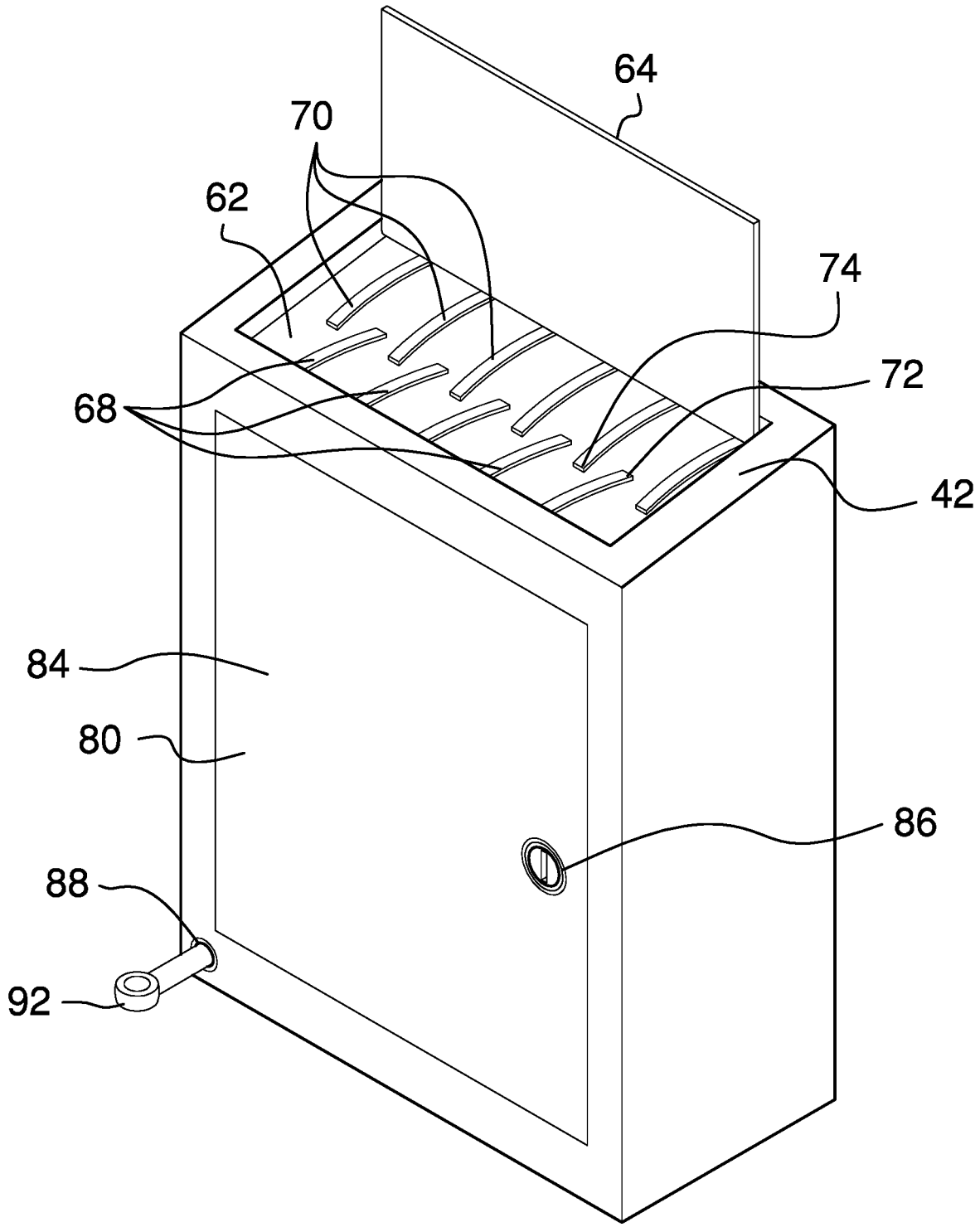
FIG. 4 is an isometric perspective view of an embodiment of the disclosure.

A bolt hole 88 is positioned in the box 14 proximate to a lower corner 90 of the box 14. An eyebolt 92 selectively threadedly insertable into the bolt hole 88, as shown in FIG. 4, so that the eyebolt 92 is coupled to the box 14. The eyebolt 92 is configured allow an item to be locked to the box 14. For example, a cable and padlock, not shown, could be used to secure another delivery item to the box 14.

Figure 6:
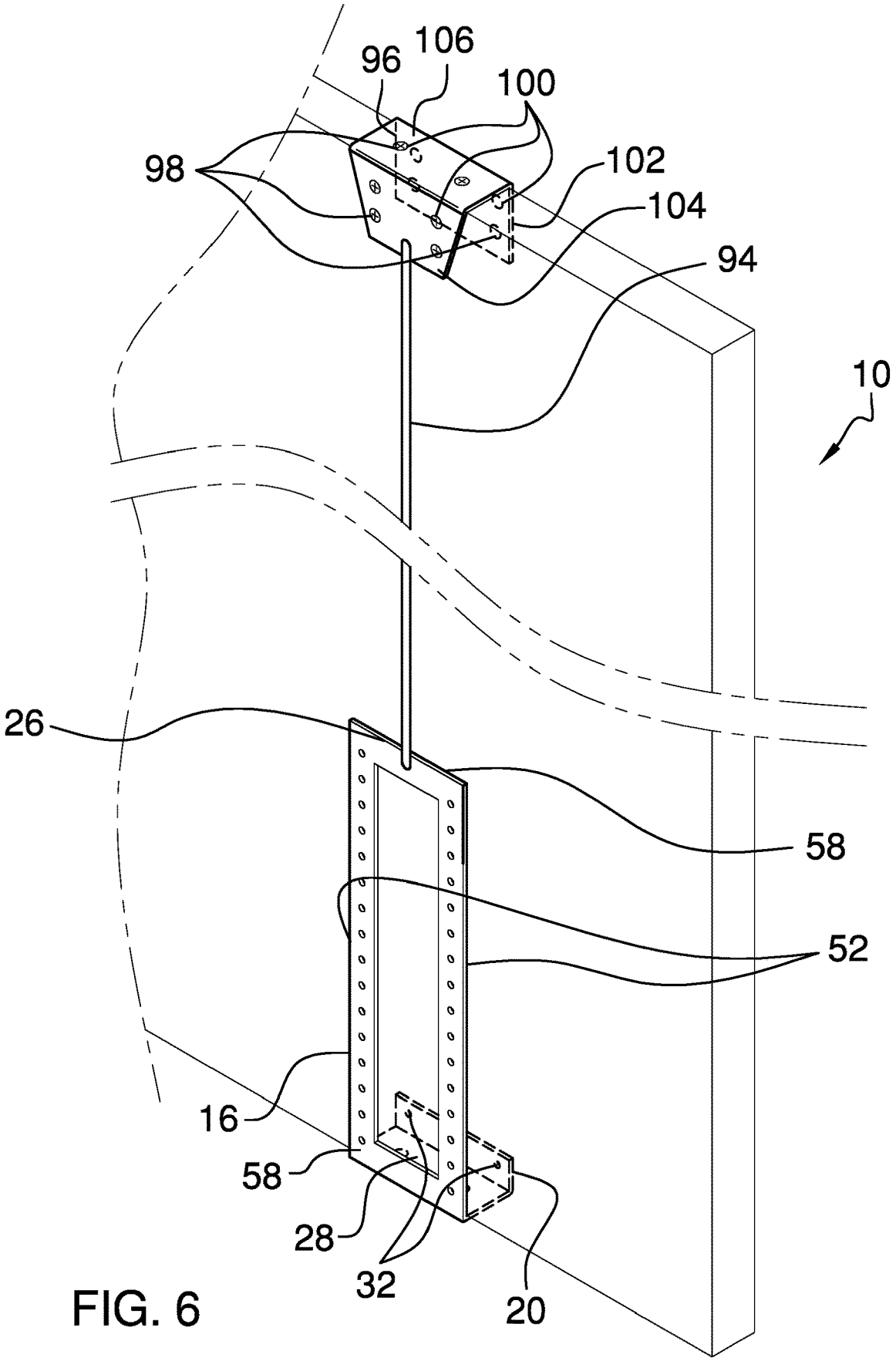
FIG. 6 is an isometric perspective of an alternative embodiment of the disclosure.

In another embodiment of the invention, as shown in FIG. 6, a connector 94 is coupled to and extends from the second endpoint 26 of the first plate 16. A second bracket 96 is coupled to the connector 94 distal from the first plate 16. The second bracket 96 is configured to selectively couple to the other of the upper end and the lower end of the entry door of the structure so that the second bracket 96 is positioned to stabilize the first bracket 12 and the box 14 relative to the exterior face of the entry door.

The second bracket 96 is C-channel type. A plurality of bracket holes 98 is positioned in the second bracket 96 so that each bracket hole 98 is positioned to insert a respective bracket screw 100 to couple the second bracket 96 to the exterior door. The plurality of bracket holes 98 comprises eight bracket holes 98, which are positioned four apiece in an interior plate 102 and an exterior plate 104 of the second bracket 96, and two bracket holes 98 that are positioned in a connecting plate 106 of the second bracket 96.

In use, each of the first holes 48 that are positioned in the box 14 each are aligned with a respective second hole 50, the bolts 54 are inserted, and the nuts 56 are threaded to the bolts 54 to couple the box 14 to the first plate 16. The first bracket 12 then is positioned over the one of the upper end and the lower end of an entry door so that the box 14 is positioned on exterior face of the entry door. Should delivery of the package take place when the recipient is not available, the delivery agent inserts the package through the aperture 62, the first tines 68, and the second tines 70 into the box 14. Theft of the package is deterred by the presence of the first tines 68 and the second tines 70. The recipient can retrieve the package through the opening 80 after unlocking the lock 86.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A secure package delivery assembly comprising:

a first bracket configured for selectively coupling to one of an upper end and a lower end of an entry door of a structure such that a first plate of the first bracket is positioned in substantial abutment to an exterior face of the entry door;

a box coupled to the first plate of the first bracket;

an aperture positioned in a top of the box wherein the aperture is configured for inserting a package into the box;

a lid hingedly coupled to the top of the box such that the lid is positioned for selectively closing the aperture;

a retention assembly coupled to and positioned in the box proximate to the top wherein the retention assembly is configured for deterring extraction of the package through the aperture;

an opening positioned in a horizontal face of the box such that the opening is positioned for retrieving the package from the box;

a panel hingedly coupled to the horizontal face, the panel being selectively couplable to the box such that the panel is positioned for selectively securely closing the opening;

a bolt hole positioned in the box proximate to a lower corner of the box; and an eyebolt selectively threadedly insertable into the bolt hole such that the eyebolt is coupled to the box wherein the eyebolt is configured for locking an item to the box.

2. The assembly of claim 1, further comprising:

the first bracket comprising a second plate and a third plate, the second plate being coupled to and extending perpendicularly from a first endpoint of the first plate, the third plate being coupled to and extending perpendicularly from the second plate distal from the first plate such that the first bracket is C-channel shaped wherein the first bracket is configured for selectively inserting the one of the upper end and the lower end of the entry door positioning the first plate, the second plate, and the third plate in substantial abutment to the exterior face, the one of the upper end and the lower end, and an interior face of the entry door, respectively; and a cutout positioned in the first plate, the cutout extending from proximate to the first endpoint to proximate to a second endpoint of the first plate for lowering a mass of the first bracket.

3. The assembly of claim 1, further comprising:

the aperture being rectangularly shaped;

the box having a front and a back, the back being dimensionally taller than the front such that the top of the box tapers from the back to the front wherein the box is configured for runoff of water from the top; and the opening being rectangularly shaped, the opening being positioned in a front of the box.

4. The assembly of claim 1, further comprising:

a plurality of first couplers coupled to a back of the box; and a plurality of second couplers coupled to the first plate, the second couplers being complementary to the first couplers wherein each second coupler is positioned for selectively coupling to a respective first coupler for coupling the box to the first plate at a selected position between the first endpoint and a second endpoint of the first plate.

5. The assembly of claim 1, further including a lock coupled to the panel, the lock being selectively couplable to the box such that the lock is positioned for locking the panel in a closed configuration, the lock being key operated.

6. A secure package delivery assembly comprising:

a first bracket configured for selectively coupling to one of an upper end and a lower end of an entry door of a structure such that a first plate of the first bracket is positioned in substantial abutment to an exterior face of the entry door;

a box coupled to the first plate of the first bracket;

an aperture positioned in a top of the box wherein the aperture is configured for inserting a package into the box;

a lid hingedly coupled to the top of the box such that the lid is positioned for selectively closing the aperture;

a retention assembly coupled to and positioned in the box proximate to the top wherein the retention assembly is configured for deterring extraction of the package through the aperture;

an opening positioned in a horizontal face of the box such that the opening is positioned for retrieving the package from the box;

a panel hingedly coupled to the horizontal face, the panel being selectively couplable to the box such that the panel is positioned for selectively securely closing the opening;

a pair of end plate holes positioned in the second plate such that each end plate hole is positioned for accepting a plate screw for selectively coupling the second plate to the one of the upper end and lower end of the exterior door; and a pair of interior plate holes positioned in the third plate, the interior plate holes being threaded such that each interior plate hole is positioned for threadedly inserting a plate bolt wherein the plate bolt is configured for tightening for removably clamping the first bracket to the exterior door.

7. The assembly of claim 6, further including the plate bolt being a clamping configuration such that a knob of the plate bolt is configured for being selectively rotated by action of a hand of a user for removably clamping the first bracket to the exterior door.

8. A secure package delivery assembly comprising:

a first bracket configured for selectively coupling to one of an upper end and a lower end of an entry door of a structure such that a first plate of the first bracket is positioned in substantial abutment to an exterior face of the entry door;

a box coupled to the first plate of the first bracket;

an aperture positioned in a top of the box wherein the aperture is configured for inserting a package into the box;

a lid hingedly coupled to the top of the box such that the lid is positioned for selectively closing the aperture;

a retention assembly coupled to and positioned in the box proximate to the top wherein the retention assembly is configured for deterring extraction of the package through the aperture;

an opening positioned in a horizontal face of the box such that the opening is positioned for retrieving the package from the box;

a panel hingedly coupled to the horizontal face, the panel being selectively couplable to the box such that the panel is positioned for selectively securely closing the opening;

a plurality of first couplers coupled to a back of the box;

a plurality of second couplers coupled to the first plate, the second couplers being complementary to the first couplers wherein each second coupler is positioned for selectively coupling to a respective first coupler for coupling the box to the first plate at a selected position between the first endpoint and a second endpoint of the first plate; and the plurality first couplers comprising a plurality of first holes, the plurality of second couplers comprising a plurality of second holes, each second hole being positioned proximate to a respective opposing edge of the first plate such that the second hole is selectively alignable with a respective first hole positioning the second hole and the respective first hole for inserting a respective bolt such that the respective bolt is positioned for coupling to a respective nut for coupling the box to the first plate.

9. The assembly of claim 8, further including the plurality of first holes comprising four first holes, the plurality of second holes comprising two rows of second holes positioned singly proximate to each opposing edge of the first plate, each row extending from proximate to the first endpoint to proximate to the second endpoint of the first plate.

10. The assembly of claim 8, further including a plurality of washers, each washer being selectively positionable over a respective bolt between a respective nut and the back of the box such that the washer is positioned for facilitating rotation of the respective nut on the respective bolt.

11. A secure package delivery assembly comprising:

a first bracket configured for selectively coupling to one of an upper end and a lower end of an entry door of a structure such that a first plate of the first bracket is positioned in substantial abutment to an exterior face of the entry door;

a box coupled to the first plate of the first bracket;

an aperture positioned in a top of the box wherein the aperture is configured for inserting a package into the box;

a lid hingedly coupled to the top of the box such that the lid is positioned for selectively closing the aperture;

a retention assembly coupled to and positioned in the box proximate to the top wherein the retention assembly is configured for deterring extraction of the package through the aperture;

an opening positioned in a horizontal face of the box such that the opening is positioned for retrieving the package from the box;

a panel hingedly coupled to the horizontal face, the panel being selectively couplable to the box such that the panel is positioned for selectively securely closing the opening; and the retention assembly comprising a plurality of first tines and a plurality of second tines, the first tines and the second tines being hingedly coupled to and extending substantially perpendicularly from a front and a back of the box, respectively, into the aperture such that a terminus of each first tine and an end of each second tine are positioned substantially equally distant from the front and the back, the first tines and the second tines being spring-loaded such that the first tines and the second tines are configured for pivoting toward a bottom of the box for inserting the package and for rebounding for deterring extraction of the package through the aperture.

12. The assembly of claim 11, further including the first tines and the second tines being arcuate such that the first tines and the second tines extend arcuately toward the bottom of the box, the first tines and the second tines being alternately positioned relative to opposing sides of the box, the plurality of first tines comprising from three to seven first tines, the plurality of second tines comprising from four to eight second tines.

13. The assembly of claim 12, further including the plurality of first tines comprising five first tines, the plurality of second tines comprising six second tines.

14. A secure package delivery assembly comprising:

a first bracket configured for selectively coupling to one of an upper end and a lower end of an entry door of a structure such that a first plate of the first bracket is positioned in substantial abutment to an exterior face of the entry door;

a box coupled to the first plate of the first bracket;

an aperture positioned in a top of the box wherein the aperture is configured for inserting a package into the box;

a lid hingedly coupled to the top of the box such that the lid is positioned for selectively closing the aperture;

a retention assembly coupled to and positioned in the box proximate to the top wherein the retention assembly is configured for deterring extraction of the package through the aperture;

an opening positioned in a horizontal face of the box such that the opening is positioned for retrieving the package from the box;

a panel hingedly coupled to the horizontal face, the panel being selectively couplable to the box such that the panel is positioned for selectively securely closing the opening;

a connector coupled to and extending from a second endpoint of the first plate; and a second bracket coupled to the connector distal from the first plate, the second bracket being configured for selectively coupling to the other of the upper end and the lower end of the entry door of the structure such that the second bracket is positioned for stabilizing the first bracket and the box relative to the exterior face of the entry door.

15. The assembly of claim 14, further comprising:

the second bracket being C-channel shaped; and a plurality of bracket holes positioned in the second bracket such that each bracket hole is positioned for inserting a respective bracket screw for coupling the second bracket to the exterior door.

16. The assembly of claim 15, further including the plurality of bracket holes comprising eight bracket holes positioned four apiece in an interior plate and an exterior plate of the second bracket and two bracket holes positioned in a connecting plate of the second bracket.

17. A secure package delivery assembly comprising:

a first bracket configured for selectively coupling to one of an upper end and a lower end of an entry door of a structure such that a first plate of the first bracket is positioned in substantial abutment to an exterior face of the entry door, the first bracket comprising a second plate and a third plate, the second plate being coupled to and extending perpendicularly from a first endpoint of the first plate, the third plate being coupled to and extending perpendicularly from the second plate distal from the first plate such that the first bracket is C-channel shaped wherein the first bracket is configured for selectively inserting the one of the upper end and the lower end of the entry door positioning the first plate, the second plate, and the third plate in substantial abutment to the exterior face, the one of the upper end and the lower end, and an interior face of the entry door, respectively;

a cutout positioned in the first plate, the cutout extending from proximate to the first endpoint to proximate to a second endpoint of the first plate for lowering a mass of the first bracket;

a pair of end plate holes positioned in the second plate such that each end plate hole is positioned for accepting a plate screw for selectively coupling the second plate to the one of the upper end and lower end of the exterior door;

a pair of interior plate holes positioned in the third plate, the interior plate holes being threaded such that each interior plate hole is positioned for threadedly inserting a plate bolt wherein the plate bolt is configured for tightening for removably clamping the first bracket to the exterior door, the plate bolt being a clamping configuration such that a knob of the plate bolt is configured for being selectively rotated by action of a hand of a user for removably clamping the first bracket to the exterior door;

a box coupled to the first plate of the first bracket, the box having a front and a back, the back being dimensionally taller than the front such that a top of the box tapers from the back to the front wherein the box is configured for runoff of water from the top;

a plurality of first couplers coupled to the back of the box;

a plurality of second couplers coupled to the first plate, the second couplers being complementary to the first couplers wherein each second coupler is positioned for selectively coupling to a respective first coupler for coupling the box to the first plate at a selected position between the first endpoint and the second endpoint of the first plate, the plurality first couplers comprising a plurality of first holes, the plurality of second couplers comprising a plurality of second holes, each second hole being positioned proximate to a respective opposing edge of the first plate such that the second hole is selectively alignable with a respective first hole positioning the second hole and the respective first hole for inserting a respective bolt such that the respective bolt is positioned for coupling to a respective nut for coupling the box to the first plate, the plurality of first holes comprising four first holes, the plurality of second holes comprising two rows of second holes positioned singly proximate to each opposing edge of the first plate, each row extending from proximate to the first endpoint to proximate to the second endpoint of the first plate;

a plurality of washers, each washer being selectively positionable over a respective bolt between a respective nut and the back of the box such that the washer is positioned for facilitating rotation of the respective nut on the respective bolt;

an aperture positioned in the top of the box wherein the aperture is configured for inserting a package into the box, the aperture being rectangularly shaped;

a lid hingedly coupled to the top of the box such that the lid is positioned for selectively closing the aperture;

a retention assembly coupled to and positioned in the box proximate to the top wherein the retention assembly is configured for deterring extraction of the package through the aperture, the retention assembly comprising a plurality of first tines and a plurality of second tines, the first tines and the second tines being hingedly coupled to and extending substantially perpendicularly from the front and the back of the box, respectively, into the aperture such that a terminus of each first tine and an end of each second tine are positioned substantially equally distant from the front and the back, the first tines and the second tines being spring-loaded such that the first tines and the second tines are configured for pivoting toward a bottom of the box for inserting the package and for rebounding for deterring extraction of the package through the aperture, the first tines and the second tines being arcuate such that the first tines and the second tines extend arcuately toward the bottom of the box, the first tines and the second tines being alternately positioned relative to opposing sides of the box, the plurality of first tines comprising from three to seven first tines, the plurality of second tines comprising from four to eight second tines, the plurality of first tines comprising five first tines, the plurality of second tines comprising six second tines;

an opening positioned in a horizontal face of the box such that the opening is positioned for retrieving the package from the box, the opening being rectangularly shaped, the opening being positioned in a front of the box, the opening being positioned in a respective opposing side of the box;

a panel hingedly coupled to the horizontal face, the panel being selectively couplable to the box such that the panel is positioned for selectively securely closing the opening;

a lock coupled to the panel, the lock being selectively couplable to the box such that the lock is positioned for locking the panel in a closed configuration, the lock being key operated;

a bolt hole positioned in the box proximate to a lower corner of the box;

an eyebolt selectively threadedly insertable into the bolt hole such that the eyebolt is coupled to the box wherein the eyebolt is configured for locking an item to the box;

a connector coupled to and extending from the second endpoint of the first plate;

a second bracket coupled to the connector distal from the first plate, the second bracket being configured for selectively coupling to the other of the upper end and the lower end of the entry door of the structure such that the second bracket is positioned for stabilizing the first bracket and the box relative to the exterior face of the entry door; the second bracket being C-channel shaped; and a plurality of bracket holes positioned in the second bracket such that each bracket hole is positioned for inserting a respective bracket screw for coupling the second bracket to the exterior door, the plurality of bracket holes comprising eight bracket holes positioned four apiece in an interior plate and an exterior plate of the second bracket and two bracket holes positioned in a connecting plate of the second bracket.

* * * * *